United States Patent [19]

Koppenberg

[11] Patent Number: 4,614,066

[45] Date of Patent: Sep. 30, 1986

[54] MODULAR COLUMBARIUM STRUCTURE

[76] Inventor: Bruce G. Koppenberg, 9674 Mt. Baker Hwy., Deming, Wash. 98244

[21] Appl. No.: 806,425

[22] Filed: Dec. 9, 1985

[51] Int. Cl.[4] ..... E04H 13/00

[52] U.S. Cl. ..... 52/134; 52/79.9; 52/136; 312/111

[58] Field of Search ..... 52/134–137, 52/79.1, 79.2, 79.3, 79.4, 79.9–79.13; 312/111

[56] References Cited

U.S. PATENT DOCUMENTS

| | | | |
|---|---|---|---|
| 3,754,805 | 8/1973 | Pangburn et al. | 52/136 X |
| 3,905,167 | 9/1975 | Watkins et al. | 52/79.9 X |
| 4,073,100 | 2/1978 | Di Giovanni | 52/79.9 X |
| 4,503,781 | 3/1985 | Nilsson | 312/111 X |
| 4,518,207 | 5/1985 | Gavronsky | 312/111 X |
| 4,523,413 | 6/1985 | Koppenberg | 52/134 X |

FOREIGN PATENT DOCUMENTS

| | | | |
|---|---|---|---|
| 2551793 | 3/1985 | France | 52/136 |

*Primary Examiner*—J. Karl Bell

*Attorney, Agent, or Firm*—Kolisch, Hartwell & Dickinson

[57] ABSTRACT

A columbarium structure made from a multiplicity of preformed niche units or modules. The units are secured together utilizing brackets spanning coplanar walls of adjacent units, channel members overlying parallel and adjacent front edges in units, and rosettes secured to the brackets and overlying ends of the channel members.

9 Claims, 6 Drawing Figures

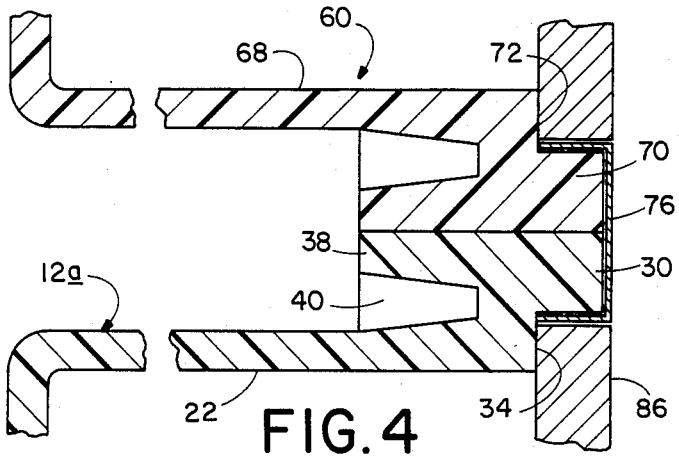
FIG. 4
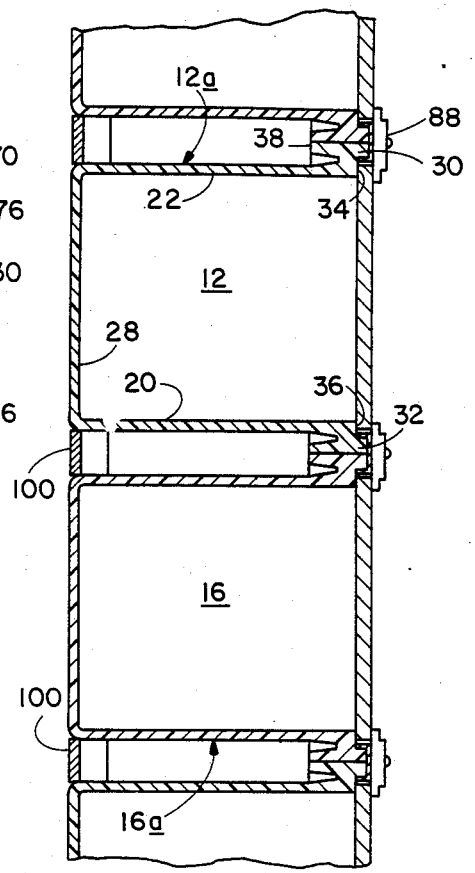
FIG. 3
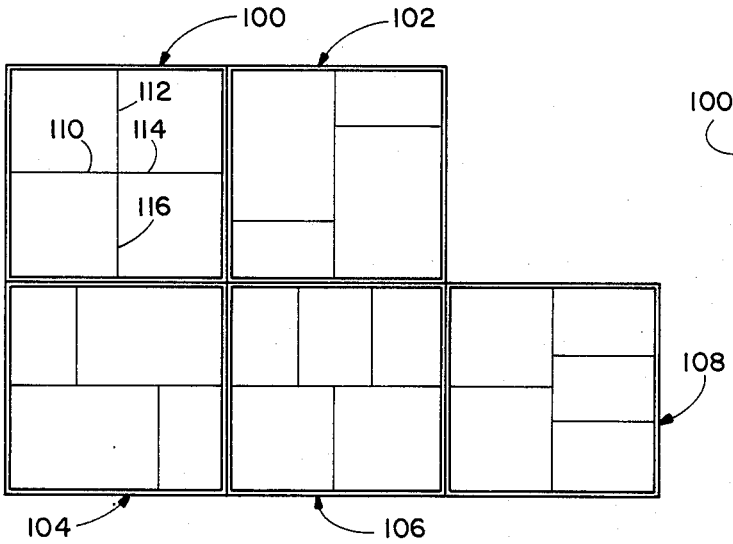
FIG. 6
FIG. 5
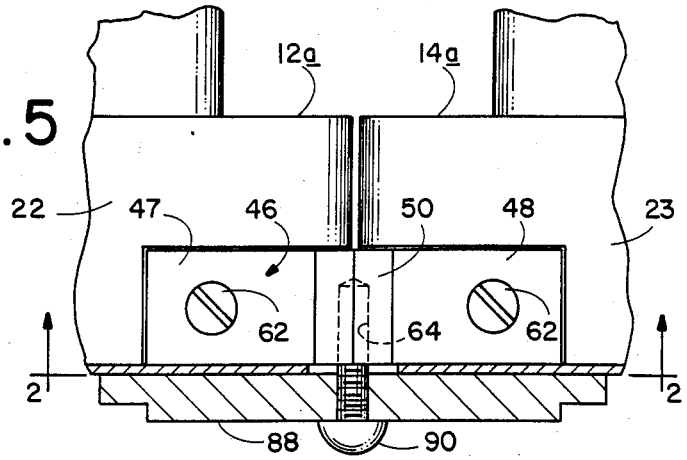

MODULAR COLUMBARIUM STRUCTURE

BACKGROUND AND SUMMARY OF THE INVENTION

This invention relates to a columbarium structure, and more particularly to such a structure which is formed of preformed niche units, each of substantially rectangular cross section and the units being arranged in vertical and horizontally extending rows in the structure.

Columbarium structures are known which comprise vertical and horizontally extending walls forming a gridwork in the structure and forming internal niches for the reception of cremation urns and the like. One form of such a structure may conveniently be prepared as a concrete casting with the concrete formed over prearranged tub-shaped molds. At the completion of the casting operation, the respective molds are removed to leave a unitary concrete structure with open niches formed therein and facing one side of the structure cast. This type of structure is illustrated in my prior filed application entitled APPARATUS FOR CASTING CONCRETE, filed on Mar. 29, 1984 and having Ser. No. 594,539 now U.S. Pat. No. 4,566,668. The structure described provides a highly satisfactory type of columbarium which is relatively easily manufactured at low cost. The structure, however, is not readily adapted to manufacture in subsequent shipment to an installation site located a substantial distance from the point of manufacture, due to the weight and size of the unit produced.

This invention features preformed niche units which are assembled together in a modular type of structure to produce the complete columbarium. The niche units may be produced as standardized modules which are readily interconnected to produce the final structure. By changing the number and manner in which various modules are interconnected, flexibility is provided in determining the size and configuration of the columbarium ultimately produced.

In a preferred form of the invention, the niche units or modules described are made of plastic such as a polyethylene foam. Such a material has requisite strength to produce a final structure of suitable rigidity to perform the function intended for the structure. The plastic composition contemplated enables modules to be interconnected by brackets spanning adjacent modules and secured as by screws to the adjacent modules. Further, such a plastic material is available in different colors which are attractive and essential permanently retained by the plastic making up the modules.

Very importantly, the modular type of construction contemplated, and the plastic composition of the modules themselves, result in reduced shipping costs, with the modules being more easily handled and of considerably less weight than an integral concrete casting formed with a multiplicity of niches therein.

A general object of the invention, therefore, is to provide an improved modular type of construction for a columbarium structure featuring niche units or modules interconnected in the structure.

Another object is to provide such a columbarium structure where the niche units or modules have a plastic composition, and are interconnected in such a manner as to have suitable rigidity and strength.

A further object is to provide a columbarium structure featuring niche units or modules disposed in rows, where the units are interconnected in the structure by brackets spanning adjacent coplanar walls in the units.

The columbarium structure of the invention features channel members that fit over and thus intersecure parallel front edges in the niche units. These channel members and any closure fronts or panels provided to close the niche units in the final structure, are all held in place by rosettes or holding plates fastened to brackets which interconnect modules in the structure.

Various other objects and advantages are obtained by the invention, which is described hereinbelow in conjunction with the accompanying drawings, wherein:

FIG. 3 is a cross-sectional view, taken generally along the line 3—3 in FIG. 1;

FIG. 4 is a cross-sectional view, taken generally along the line 4—4 in FIG. 1 and on a slightly larger scale;

FIG. 5 is a cross-sectional view, on substantially the scale of FIG. 4, and taken along the line 5—5 in FIG. 1; and FIG. 6 is a simplified view, illustrating in front elevation a modified form of columbarium structure.

Figure 1:
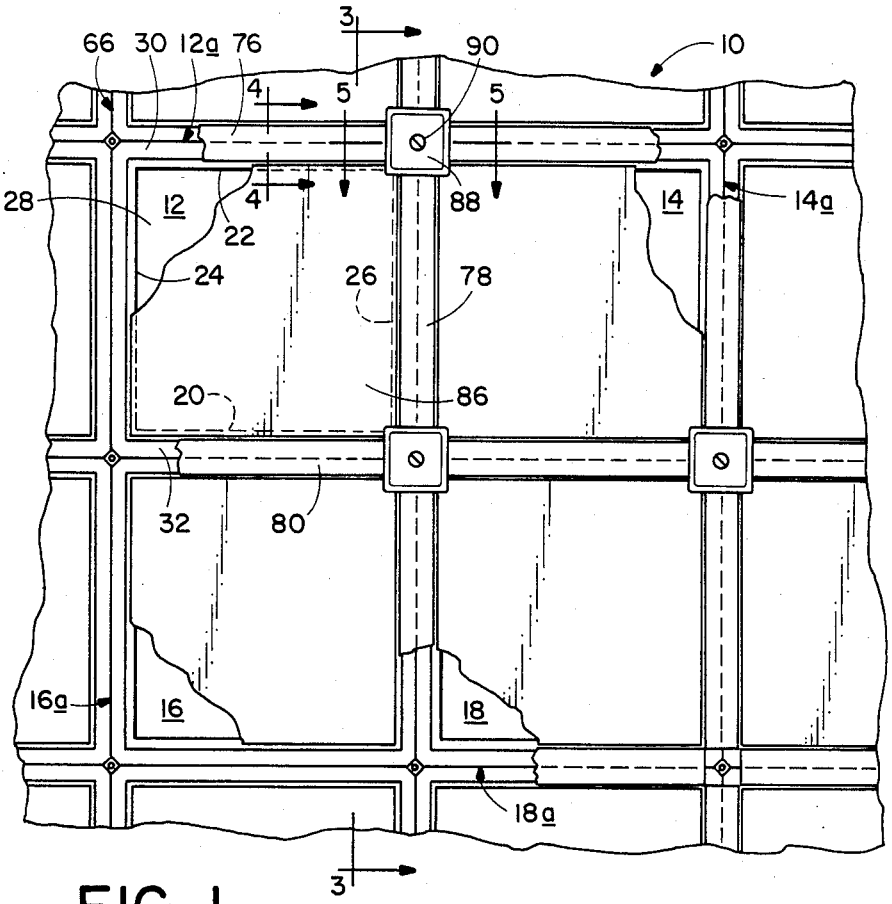
FIG. 1 is a front elevation view of portions of a columbarium structure constructed according to the invention, and with portions broken away to illustrate details.

Referring now to the drawings, and initially to FIG. 1, illustrated generally at 10 is the front of a columbarium structure which has defined therein a multiplicity of recessed chambers or niches, as exemplified by those shown at 12, 14, 16, and 18. These are arranged in rows in the structure, and are adapted to receive cremation urns and the like.

Referring now also to FIG. 3, each niche is defined by a niche unit or module, indicated for niches 12, 14, 16, and 18 by the units or modules 12A, 14A, 16A, and 18A.

In the form of the invention presently being described, the units or modules all have the same construction. Thus, each unit includes, and with reference to module 12A, a bottom wall 20, a top wall 22, and opposed side walls 24, 26. Each unit is open at its front, which is the side of the unit facing the viewer in FIG. 1 and facing to the right in FIG. 3. Each unit further includes a back wall 28 closing off the back of the unit.

The various walls described impart a substantially rectangular cross section to the unit in elevation, with the walls described forming what might be thought of as a rectangular tub.

Further describing a niche unit or module, each of the walls which surround a niche, i.e., top and bottom walls 22, 20 and side walls 24, 26 in the case of module 12A, has a front edge which is formed as a ridge disposed laterally outwardly on the unit. This is illustrated in FIG. 3 by ridge 30, 32 forming the front edges of walls 22, 20. Each wall has a shelf disposed laterally inwardly of its ridge, as exemplified by shelves 34, 36 of walls 22, 20, respectively. Each niche unit may further be provided for each of its niche bounding walls (i.e., walls 20, 22, 24, 26 for niche unit 12A) with a rearwardly extending flange, as exemplified by flange 38 of wall 22 shown in FIGS. 3 and 4. These add strength to the front end of the unit. Further, if desired, strengthening webs 40 may be included, spaced at intervals along the length of a wall, interconnecting the wall with its associated flange (see FIG. 4).

As briefly discussed earlier, it is preferred that the niche units or modules be prepared from a foam plastic such as a foam polyolefin. Such a material has requisite strength, can be colored appropriately, and has considerably less mass than, for instance, cast concrete commonly found in past columbarium structures. By way of specific example, a foam polyethylene plastic has been used having a specific gravity of approximately 0.8. A one-quarter inch wall thickness exemplifies a wall thickness used in the various walls in a niche unit.

In the completed structure, and referring now to FIG. 1, the units may be organized with such extending in vertical and horizontal rows. Thus, unit 12A is vertically aligned with unit 16A and horizontally aligned with unit 14A. Unit 18A is horizontally aligned with unit 16A and vertically aligned with unit 14A. With this organization, wall 26 in unit 12A parallels and lies adjacent a side wall in unit 14A. Top wall 22 in unit 12A parallels and lies adjacent a bottom wall in the niche unit directly above it. Wall 22 in unit 12A is coplanar with the top wall of unit 14A which is horizontally aligned with and directly adjacent unit 12A.

Channel members and brackets are employed to secure the various units or modules together in the completed structure as will now be described.

Figure 2:
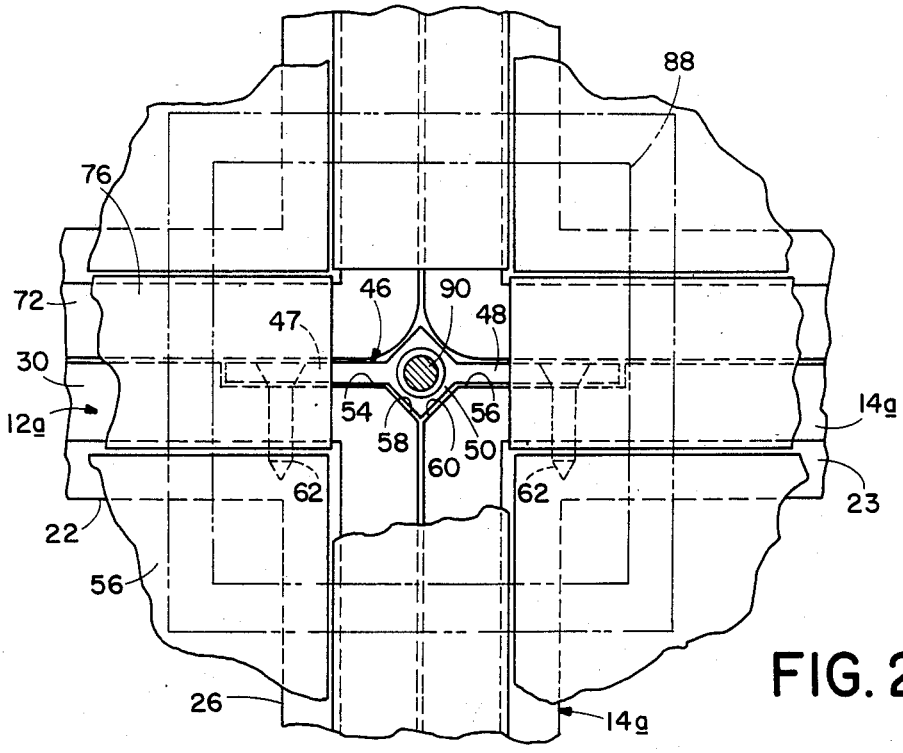
FIG. 2 illustrates, on a somewhat larger scale, and again with portions broken away, a portion of the front of a columbarium structure where four niche units come together.

Specifically, and now referring to FIGS. 1, 2, and 5, adjacent units or modules may be secured together in regions where such have coplanar walls with a bracket which spans these coplanar walls and is secured to the two units presenting these walls. The bracket may further provide a receptor means for receiving a fastener such as a screw fastener utilized in the mounting of other components in the assembly.

Thus, and considering units 12A and 14A, such have top walls which are coplanar in the structure shown in FIG. 2, exemplified by a wall 22 of unit 12A and a corresponding wall in unit 14A now given the reference numeral 23. Spanning these walls is a bracket 46 including legs 47, 48 and a central portion 50. For the legs of the bracket to lie flush with the outer surfaces of the walls involved, it may be desirable to have the walls suitably recessed to receive the bracket, as exemplified by recesses 54, 56 receiving the bracket legs and recesses 58, 60 receiving the bottom of central portion 50. Suitable bores provided in the legs accommodate fasteners, such as screw 62, passing through the legs and screwed into the materials of the walls thus securely to mount the bracket in place.

The bracket described is shown extending horizontally, interconnecting horizontally aligned units disposed inwardly from the sides of the structure. At the extreme sides vertically extending brackets may be employed interconnecting coplanar walls in the structure.

Central portion 50 of bracket 46 has an internally threaded bore 64, i.e., a receptor means, for receiving a fastener such as a threaded screw used in securing other components in the assembly.

Ridges have been described which form the front edges of the units, exemplified by ridge 30 of unit 12A forming part of the upper wall 22. Each ridge is bordered by a shelf, exemplified by shelf 34 associated with wall 22 of unit 12A. In the module directly above module 12A, now given reference numeral 66 in FIGS. 1 and 4, bottom wall 68 terminates at the front of the unit in a ridge 70 bordered by shelf 72. The ridges of the adjacent modules, namely ridges 30, 70, collectively form, in effect, a shallow tongue, and fitted over this tongue is a channel member 76. This channel member extends the entire length of ridges 30, 70, i.e., the distance between where these ridges meet with vertical ridges at opposite corners of the modules involved.

Channel member 76 has been described interconnecting the front edges of modules 12A and 76 where such are adjacent. Similar channel members (see FIG. 1) connect the front edges of adjacent modules 12A and 14A (channel member 78), adjacent front edges of modules 12A and 16A (channel member 80), and adjacent front edges of module 12A and the module directly to its left (removed from the drawing in FIG. 1). This organization of channel members fitting over adjacent and parallel front edges of the modules is continued throughout the entire front face of the columbarium structure.

The shelves described, which are associated with each of the side walls in a unit, in addition to receiving the side flanges of a channel member, also perform the important function of providing a seat for closure fronts which close off the fronts of the niches in the columbarium structure. Specifically, and referring to FIGS. 1, 2, and 3, unit 12A has its front closed off by a closure front or panel 86. Its top edge (see FIG. 3) seats in shelf 34, its bottom edge in shelf 36, and its opposite side edges in corresponding shelves provided in walls 24, 26. These fronts may be made of a variety of materials such as polished marble, stained glass, bronze, etc.

Securing the channel members and also the closure fronts in place are "rosettes" or holding plates, exemplified by rosette 88. In the particular form of the invention shown, such has a substantially square shape, and extends to overlap the four channel members which extend thereunder at a set of corners in the columbarium structure. Corner extremities of the rosettes overlap the closure fronts closing off the four niche units which come together at the location of the rosette. The rosette is fastened into the structure by means of a screw or fastener 90 (see FIG. 5), which has its threaded end screwed into and thus received by internally threaded bore 64 in the bracket which appears directly behind the rosette.

It should be obvious that the structure described permits ready assembly of a multiplicity of units or modules with such arranged in rows and integrated in the structure through use of the brackets, channel members and rosettes, the rosettes serving the further purpose of holding in place the closure fronts associated with the various niches.

The niche units or modules may be supported at rear extremities utilizing a grid-like network, shown at 100 in FIG. 3.

In FIG. 6, there is illustrated, in simplified form, a modification of the invention. In the structure illustrated, five modules are shown indicated at 100, 102, 104, 106, and 108. Each may be formed as an integral unit from foamed plastic as described in connection with the first modification of the invention discussed herein. Each unit has internal walls, exemplified by walls 110, 112, 114, and 116 for unit 100, dividing the interior of the unit into multiple recessed chambers or niches. The wall pattern of unit 102 is the same as unit 104, but the units have been placed in the module with sides facing in different directions. The same comments refer to modules 106, 108 which are similar but differently positioned in the total structure. In the structure, the various modules may be interconnected utilizing brackets, channel members and rosettes, as earlier discussed, with such securing the modules together in the structure. Closure panels may be selected which close the entire open front of a module and the niches defined within the module.

The foam plastic material used preferably in structural foam, formed under its own expansional pressure in the sealed mold, regulated by the amount of accompanying gas fed along with the liquid plastic. In the process, greater density tends to be found adjacent the outer surfaces of the molded object with less density in the interior of a wall.

While variations and modifications of the invention have been described, it should be obvious that other variations are possible without departing from the invention. It is desired, therefore, to cover all such variations and modifications as would be apparent to one of skill in the art and coming within the scope of the invention.

It is claimed and desired to secure by Letters Patent:

1. A columbarium structure comprising at least a pair of preformed niche units, each unit having bottom and top walls and opposed side walls substantially normal to the bottom and top walls and imparting a substantially rectangular cross-section to the unit in elevation, the walls of the unit having front edges defining an open front for the unit, said unit having a foam plastic composition, said units being disposed with a wall in one unit paralleling and adjacent a wall in the other unit and with other walls in the units substantially coplanar, a bracket spanning and secured to said other coplanar walls adjacent the front of the units holding the units together at a fastening zone, a channel member fitting over front edges of parallel walls of the units, and a holding plate secured to said bracket and holding the channel member in place.

2. The structure of claim 1, wherein said other coplanar walls have substantial thickness, and said bracket is secured to said coplanar walls by screws extending transversely of and embedded within said coplanar walls.

3. The structure of claim 1, wherein the front edge of each wall of the units is formed by a ridge disposed laterally outwardly on the unit, and wherein each wall has a shelf disposed laterally inwardly of the wall's ridge bordering the inner side of the ridge, and which further comprises closure panel means seated within the collective shelves of a unit.

4. The structure of claim 3, wherein said holding plate overlaps a portion of said closure panel means to hold the panel means in place.

5. In a columbarium structure, a plurality of preformed modular niche units composed of foam plastic extending as multiple rows in the structure, each unit having a bottom, a top, and opposed side walls imparting a substantially rectangular cross-section to the unit and the walls of a unit having front edges defining an open front for the unit, the units in the structure having parallel and adjacent walls, a channel member straddling the front edges of adjacent walls in the structure and holding the adjacent walls from lateral separation, anchor brackets secured to the walls of the units in the structure, and holding plates secured to the anchor brackets holding the channel members in place.

6. The columbarium structure of claim 5, wherein paired front edges presented by adjacent units form a rectangular grid of vertical and horizontal expanses with vertical and horizontal expanses meeting at internal corners in the grid, the channel members extend along said expanses, and said anchor brackets are located at a fastening zone for the units adjacent the front and the corners of said grid.

7. The columbarium structure of claim 6, wherein the niche units have rear walls closing the rear ends of the units and which further includes a grid framework encompassing rear portions of said units supporting the rear ends of the units.

8. The columbarium structure of claim 6, wherein walls of adjacent units in said structure at said corners are coplanar, said anchor brackets span said coplanar walls inwardly from the fronts of the units, and said anchor brackets are secured by fasteners to the coplanar walls of the units which fasteners extend transversely of and are embedded in said coplanar walls.

9. A columbarium structure comprising at least four preformed niche units aligned in rows extending horizontally and vertically in the structure, each unit having bottom and top walls and opposed side walls substantially normal to the bottom and top walls and imparting a substantially rectangular cross-section to the unit in elevation, the walls of a unit having front edges defining an open front for the unit and said units having a foam plastic composition, said units being disposed with a wall in one unit paralleling and adjacent a wall in an adjacent unit and with other walls in the units substantially coplanar, a bracket spanning and secured to said coplanar walls adjacent the front of the units holding the units together at a fastening zone, the front edges of each wall of the units comprising a ridge disposed laterally outwardly of the unit and each unit having a shelf disposed laterally inwardly of the unit's ridge bordering the inner side of the ridge, a channel member straddling front edges of the parallel walls of the units, a closure panel seated within the collective shelves of a unit closing off the front of the unit, and a holding plate secured to the bracket holding ends of channel members in place and also overlapping portions of the closure panel seated within each unit.

* * * * *